US005415284A

United States Patent [19]

King

[11] Patent Number: 5,415,284

[45] Date of Patent: May 16, 1995

[54] GOLF CLUB CARRYING CASE

[76] Inventor: Larry King, 6000 Poplar, Bellvue, Colo. 80512

[21] Appl. No.: 135,179

[22] Filed: Oct. 12, 1993

[51] Int. Cl.[6] ..... A63B 55/00; A63B 55/06; A63B 55/08

[52] U.S. Cl. ..... 206/315.6; 206/315.3; 206/315.7; 248/96; 280/DIG. 6

[58] Field of Search ..... 248/96; 211/70.2; 206/315.3-315.7; 280/DIG. 6

[56] References Cited

U.S. PATENT DOCUMENTS

| | | | |
|---|---|---|---|
| D. 172,785 | 8/1954 | Eging | 206/315.3 X |
| 1,570,500 | 1/1926 | Kennedy | 206/315.6 |
| 1,600,601 | 9/1926 | Sampson | 206/315.2 |
| 1,637,538 | 8/1927 | Sampson | 206/315.2 |
| 2,020,254 | 2/1937 | Burgner | 248/96 X |
| 2,422,315 | 6/1947 | Robinson | 206/315.7 |
| 2,726,874 | 12/1955 | Sullivan | 280/DIG. 6 X |
| 2,837,346 | 6/1958 | Chambless | 206/315.5 X |
| 3,530,919 | 9/1970 | May | 206/315.5 X |
| 3,941,398 | 3/1976 | Nelson | 206/315.4 X |
| 4,227,559 | 10/1980 | Stroman | 206/315.6 |

FOREIGN PATENT DOCUMENTS

| | | | |
|---|---|---|---|
| 9204 | 7/1933 | Australia | 206/315.4 |
| 486831 | 6/1938 | United Kingdom | 206/315.4 |
| 733631 | 7/1955 | United Kingdom | 280/DIG. 6 |
| 1295246 | 11/1972 | United Kingdom | 206/315.2 |
| 9118650 | 12/1991 | WIPO | 206/315.3 |

*Primary Examiner*—Sue A. Weaver
*Attorney, Agent, or Firm*—Dean P. Edmundson

[57] ABSTRACT

A carrying case for golf clubs is described which includes two rigid housing sections hingedly connected along abutting edges. Each housing section can support several golf clubs in an upright, spaced-apart manner. The housing sections can pivot between open and closed positions. The case also includes a handle for carrying purposes. The golf clubs are prevented from contacting each other while being carried.

9 Claims, 7 Drawing Sheets

GOLF CLUB CARRYING CASE

FIELD OF THE INVENTION

This invention relates to golf club bags and carrying cases. More particularly, this invention relates to carrying cases for golf clubs to prevent damage to the clubs while carrying them.

BACKGROUND OF THE INVENTION

A conventional golf bag is able to support and carry a multitude of various different clubs. Although some golf bags may include simple dividers for keeping some of the clubs separated from other clubs (e.g., one or more transverse bars at the open end of the bag), typically the shafts of the clubs are in constant contact with each other while they are in the bag. As a result, whenever a club is pulled from, or inserted into, the bag the shaft of the club is scraped along the shafts of other clubs in the bag. This can result in scratches or other damage to the shafts and is very undesirable. This is particularly a problem with the newer style of clubs having graphite shafts which can be very easily scratched or damaged.

Although it has been known to place plastic tubes in a conventional golf bag for receiving the shafts of the clubs, that does not prevent scratching of graphite shafts when they slide into or out of the tubes. Also, friction between top ends of the plastic tubes and the shafts of the clubs tends to wear and weaken the graphite shaft. As a result, the shaft may eventually break during use.

There has not heretofore been provided an effective golf carrying case which prevents damage to the shaft of the clubs and which also organizes the clubs.

SUMMARY OF THE PRESENT INVENTION

In accordance with the present invention there is provided a carrying case for a plurality of golf clubs which keeps the clubs organized and which prevents the clubs from contacting each other at all times. Thus, the carrying case of this invention prevents clubs from being damaged, and it is easy to use.

In one embodiment the carrying case comprises:

(a) first and second upright housing sections each having first and second side edges; wherein the first side edges of the housing sections are hingedly connected; wherein each housing section includes a base and an upper end wall; and wherein the housing sections are movable between open and closed positions;

(b) receiving means in each housing section for receiving and supporting golf clubs in an upright and spaced-apart manner; and (c) handle means for lifting and carrying the case when the housing sections are in the closed position.

When the housing sections are in their open position all of the clubs in the case are exposed and accessible. Because each club has its own space in the case, it is very easy to locate the desired club for use. It is also very easy to determine at a glance whether any clubs are missing.

The case can be easily closed by swinging or pivoting the two housing sections together. Preferably the handle means includes a strap which encircles or is otherwise connected to both of the housing sections and keeps them in their closed position while the case is being carried.

A conventional folding stand may be attached to the case, if desired, to support the carrying case in the open position on the golf course. It is also possible to put the carrying case on a conventional pull cart.

Other advantages of the carrying case of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
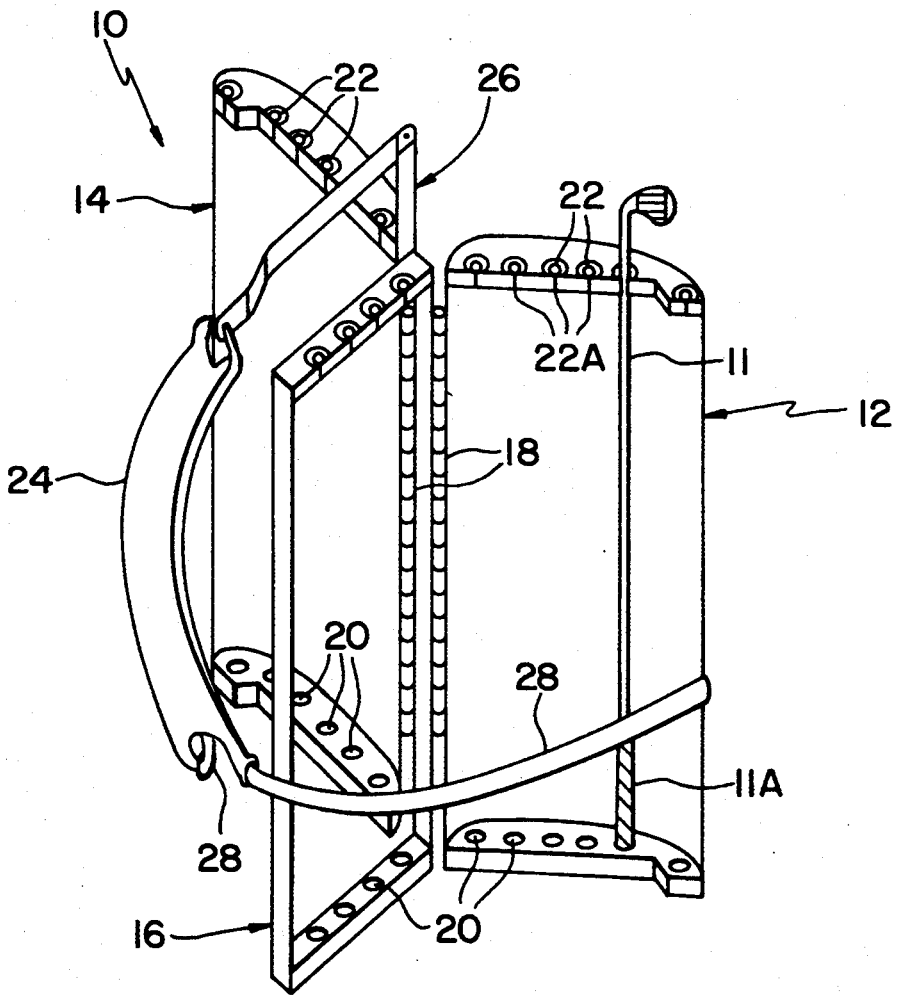
FIG. 1 is a perspective view of one embodiment of the carrying case of the invention, shown in its open position.
Figure 2:
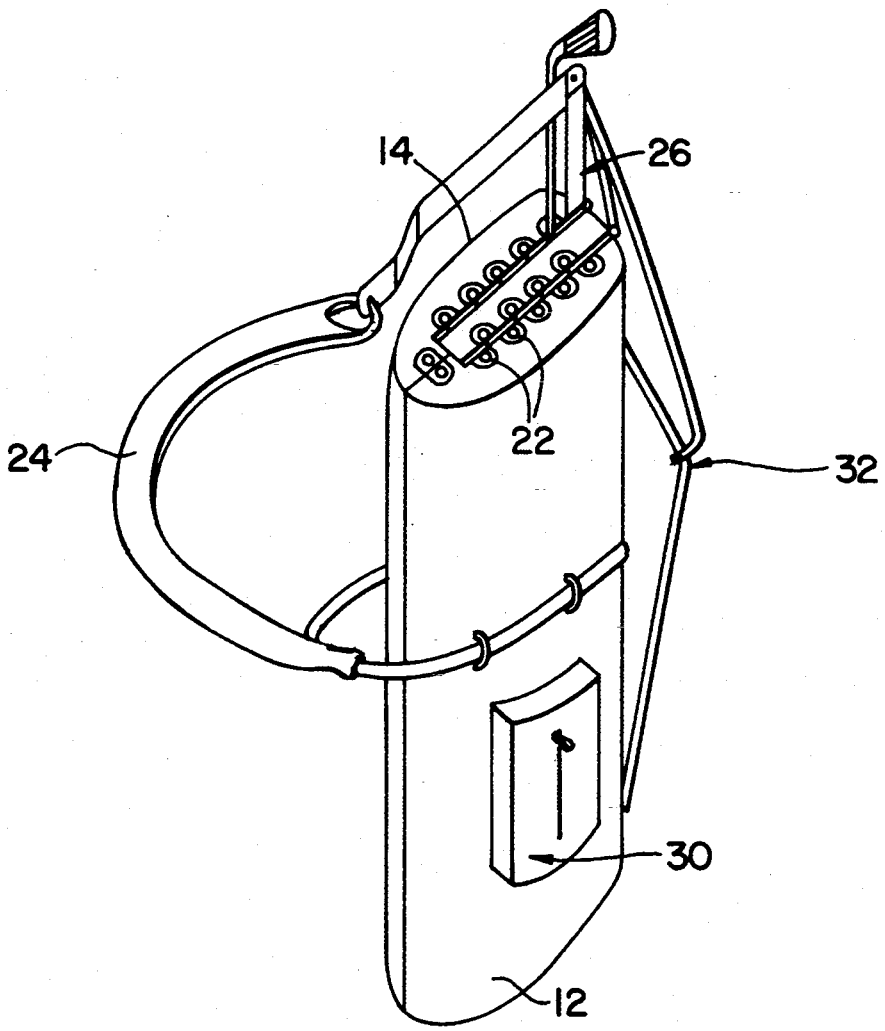
FIG. 2 is a perspective view of the carrying case of FIG. 1 in its closed position.
Figure 3:
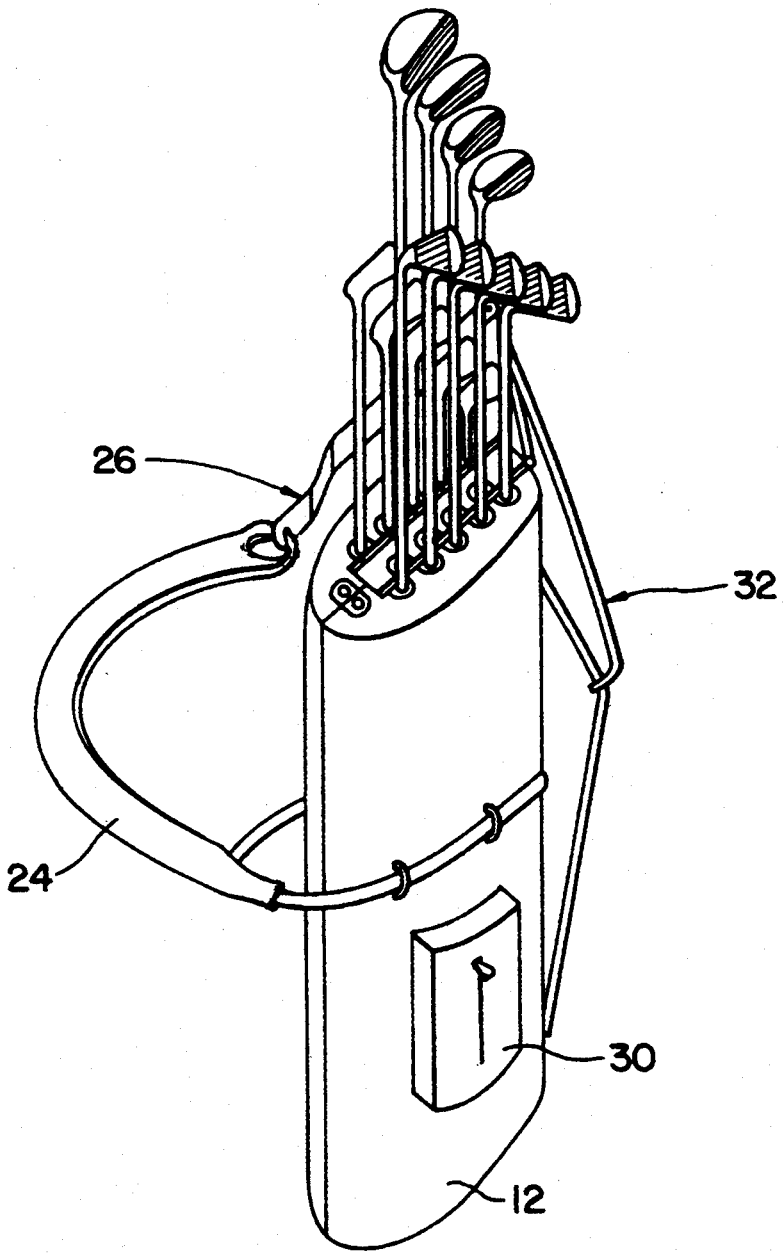
FIG. 3 is a perspective view of the carrying case of FIG. 1, shown with a full set of clubs therein.
Figure 4:
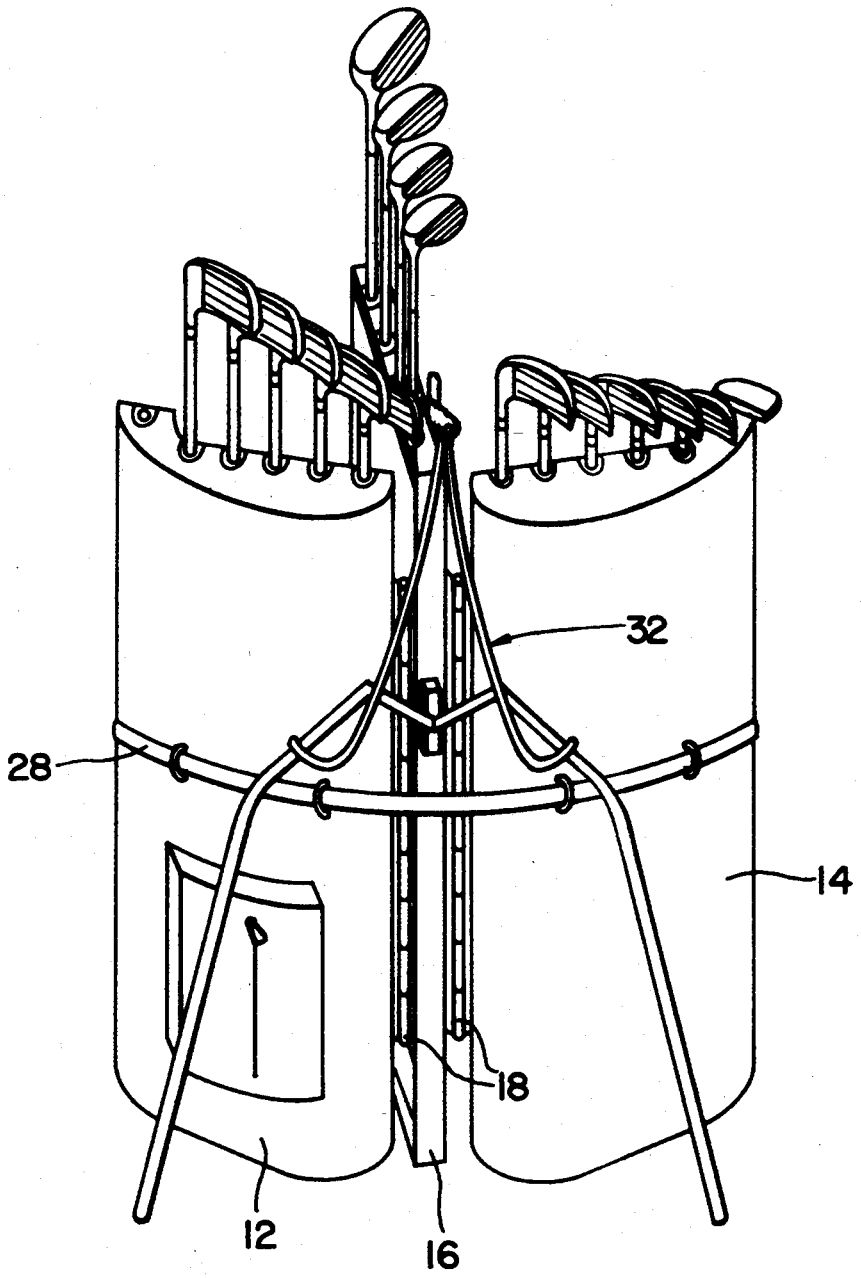
FIG. 4 is a rear perspective view of the carrying case of FIG. 3, shown in the open position.

In FIGS. 1–4 there is shown a preferred embodiment of a carrying case 10 for carrying a plurality of golf clubs. The case includes housing sections 12 and 14 which are rigid (e.g., hard plastic) and preferably have a slightly concave interior surface. This embodiment of carrying case also includes a central frame member 16. One side edge of each housing section is hingedly connected to the rear edge of the frame by means of hinges 18. The frame preferably is rectangular, as shown.

Each housing section includes receiving means for receiving and supporting golf clubs in an upright and spaced-apart manner. As shown in the drawings, each housing section and the frame includes spaced-apart recesses 20 in the base to receive the handle end 11A of each club 11. The upper or top wall of each housing section, and the frame, includes a plurality of spaced-apart notches 22 for receiving and retaining the shafts of the clubs. Preferably each notch includes foam with a vertical slit 22A through it. This enables the foam to be urged aside when the club shaft is pushed into the notch. The foam serves to grip and retain the club shaft 11 in the desired position. The foam does not scratch or damage the club shaft.

In the embodiment shown in FIG. 1, there is a handle 24 which is attached at its upper end to bracket 26 (secured to frame 16) and is attached at its lower end to flexible straps 28. The straps may encircle the two housing sections or be otherwise secured to the housing sections. By lifting on the handle, the straps cause the two housing sections to pivot to their closed position where they are in contact with the frame 16. If desired, a latch may be included on the housing sections to secure them in their closed positions.

It is also possible to include one or more exterior pockets 30 or compartments on one or both of the housing sections for storing balls, tees, gloves, etc. The pockets may be secured to the housing section by any suitable means, e.g., snaps, rivets, Velcro fasteners, or other suitable fastening means.

A conventional folding stand 32 may also be attached to the spine of the carrying case, if desired. The stand is movable between open and retracted positions. Of course, the carrying case of this invention does not require a stand at all. When the housing sections 12 and 14 are pivoted to their open position, the case will stand in an upright position without a separate stand assembly.

Figure 5:
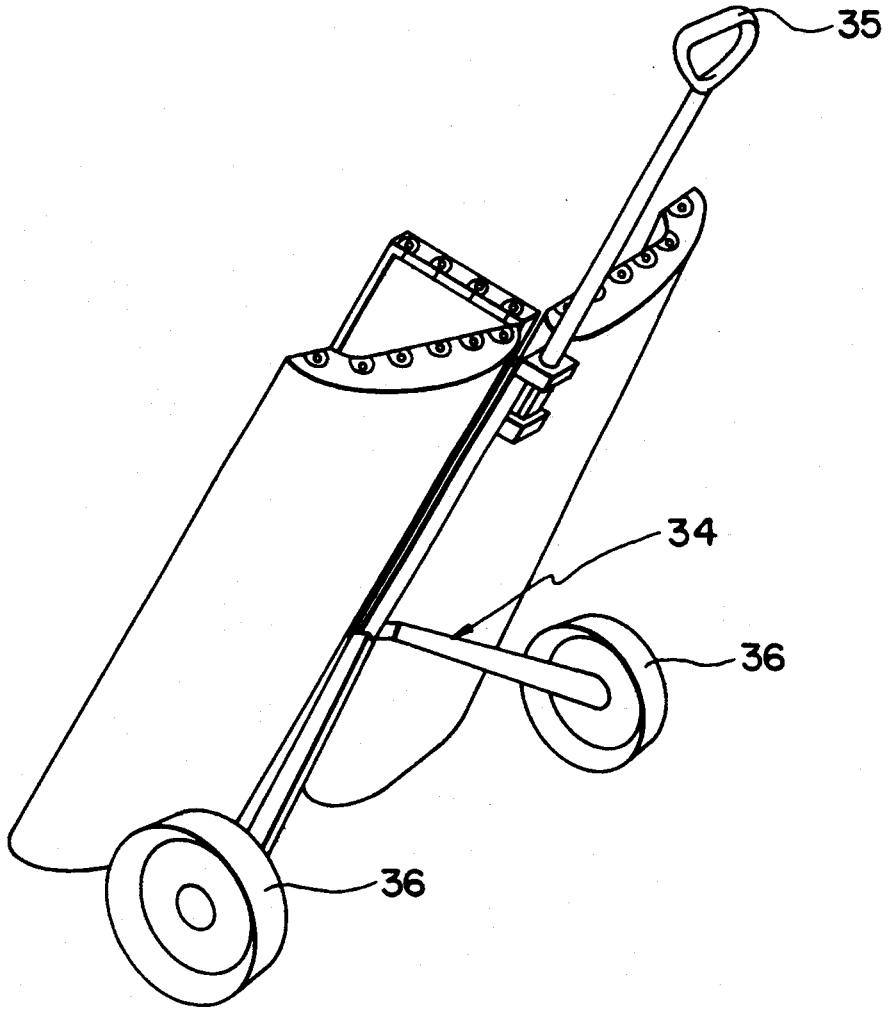
FIG. 5 is a rear perspective view of one embodiment of carrying case of the invention on a pull cart.

FIG. 5 illustrates another variation of the invention where the carrying case is supported on a cart 34 having a handle 35 and wheels 36. The case may be collapsible, if desired.

Figure 6:
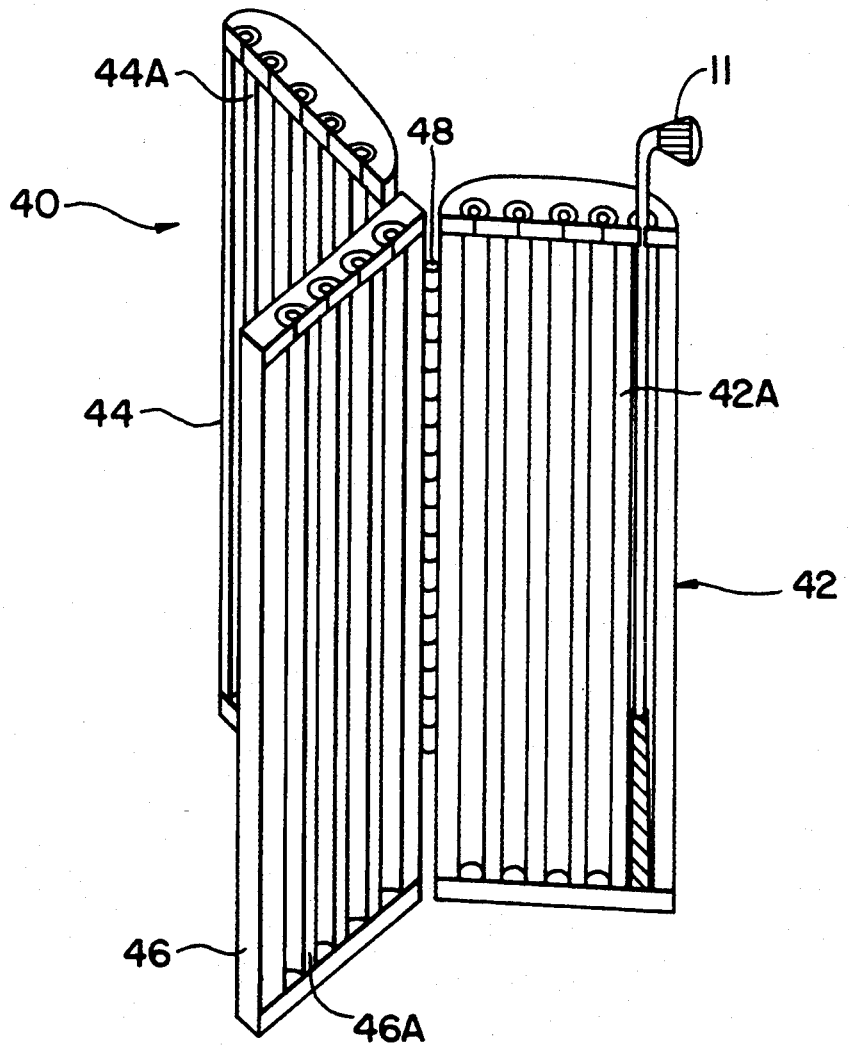
FIG. 6 is a perspective view of another embodiment of carrying case of the invention.

FIG. 6 illustrates yet another embodiment of carrying case 40 of the invention. The case comprises housing sections 42 and 44 which are hinged at one of their side edges to one side edge of central frame member 46 by means of separate hinges 48, as shown. Preferably the housing shell which is rigid (e.g., fiberglass, PVC, Kevlar, carbon fiber, or composite materials). Within each housing section there is a styrofoam insert 42A and 44A, respectively. A styrofoam insert 46A is also retained within frame member 46, as illustrated. Each styrofoam insert includes upright channels or grooves for receiving the handles and shafts of the golf clubs to be carried in the case. The inserts help to protect the shafts of the clubs in the case. The inserts may be secured in the housing sections and the frame member in any suitable manner, e.g., by means of adhesive.

Figure 7:
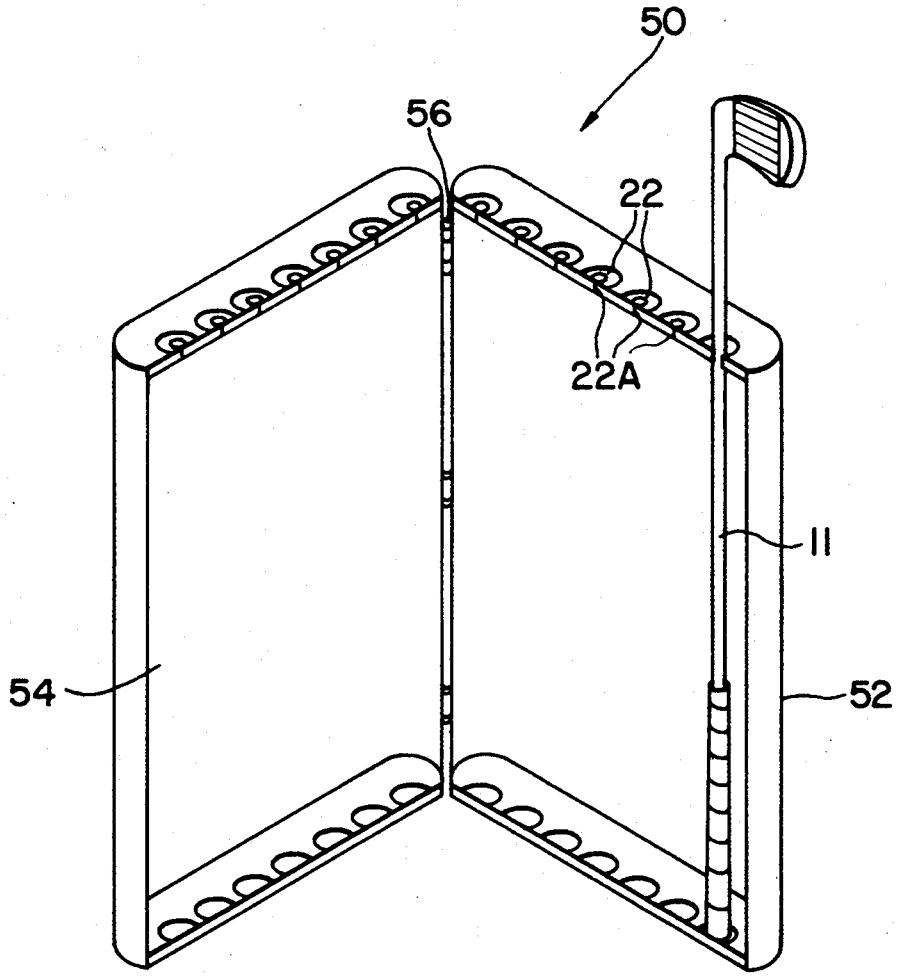
FIG. 7 is a perspective view of another embodiment of carrying case of the invention.

FIG. 7 illustrates another embodiment of carrying case 50 of the invention comprising housing sections 52 and 54 hinged together along abutting side edges by means of hinge means 56. In this embodiment of carrying case there is no central frame section. All of the golf clubs to be carried are received and supported in the two housing sections. Notches 22 in the upper end wall of each section are adapted to retain the clubs in the case. If desired, a flexible strap may encircle the housing sections to serve as a handle means for carrying the case. Of course, the ends of a length of flexible strap could be simply secured to each housing section for the same purpose. The carrying case could also include a conventional folding stand, if desired.

Other variants are possible without departing from the scope of the invention.

What is claimed is:

1. A carrying case for a plurality of golf clubs comprising:

(a) first and second upright housing sections each having first and second side edges; wherein said first side edges of said housing sections are hingedly connected; wherein each said housing section includes a base and an upper end wall; wherein said housing sections are movable between open and closed positions;

(b) receiving means in each said housing section for receiving and supporting golf clubs in an upright and spaced-apart manner; and (c) handle means for lifting and carrying said case when said housing sections are in said closed position;

(d) upright rectangular frame means having front and rear edges; wherein said first side edges of said housing sections are hingedly connected to said rear edge of said frame means; wherein said frame means further comprises retention means for receiving and supporting a plurality of golf clubs in a spaced-apart, upright manner; wherein said second side edges of said housing sections are in contact with each other adjacent said front edge of said frame means when said housing sections are in said closed position.

2. A carrying case in accordance with claim 1, wherein each said housing section includes a concave interior surface.

3. A carrying case in accordance with claim 1, wherein said receiving means comprises (a) spaced-apart notches in said upper end wall of each said housing section, and (b) spaced-apart recesses in said base of each said housing section.

4. A carrying case in accordance with claim 1, wherein said handle means is attached to said frame means.

5. A carrying case in accordance with claim 4, wherein said handle means comprises a flexible strap encircling said housing sections.

6. A carrying case for a plurality of golf clubs, said case comprising:

(a) upright rectangular frame means having front and rear edges;

(b) first and second housing members each having first and second edges; wherein said first edge of each said housing member is hingedly attached to said rear edge of said frame means; wherein said housing members are movable between open and closed positions; wherein said second side edges of said housing members are in contact with said front edge of said frame means when said housing members are in said closed position;

(c) golf club receiving means in each of said housing members for supporting a plurality of golf clubs in an upright and spaced-apart manner; and wherein said golf club receiving means comprises spaced-apart notches and recesses in each said housing member;

(d) handle means secured to said frame means for lifting and carrying said case.

7. A carrying case in accordance with claim 6, further comprising spaced-apart notches and recesses in said frame means.

8. A carrying case in accordance with claim 6, wherein said handle means comprises a flexible strap attached to said housing members.

9. A carrying case in accordance with claim 6, wherein said housing members include styrofoam inserts.

* * * * *